US009358810B2

(12) United States Patent
Fujii et al.

(10) Patent No.: US 9,358,810 B2
(45) Date of Patent: Jun. 7, 2016

(54) INKJET RECORDING METHOD AND INKJET RECORDER

(71) Applicants: Ichiroh Fujii, Kanagawa (JP); Naohiro Toda, Kanagawa (JP); Tomohiro Nakagawa, Kanagawa (JP); Hidefumi Nagashima, Kanagawa (JP); Juichi Furukawa, Kanagawa (JP)

(72) Inventors: Ichiroh Fujii, Kanagawa (JP); Naohiro Toda, Kanagawa (JP); Tomohiro Nakagawa, Kanagawa (JP); Hidefumi Nagashima, Kanagawa (JP); Juichi Furukawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/560,014

(22) Filed: Dec. 4, 2014

(65) Prior Publication Data

US 2015/0165787 A1 Jun. 18, 2015

(30) Foreign Application Priority Data

Dec. 17, 2013 (JP) ..... 2013-260197

(51) Int. Cl.

| | |
|---|---|
| ***B41J 2/01*** | (2006.01) |
| ***B41J 11/00*** | (2006.01) |
| ***B41M 5/00*** | (2006.01) |
| ***B41M 7/00*** | (2006.01) |

(52) U.S. Cl.

CPC ..... *B41J 11/002* (2013.01); *B41M 5/0023* (2013.01); *B41M 7/009* (2013.01)

(58) Field of Classification Search

CPC ..... B41J 11/002; B41M 5/0023; B41M 7/009
USPC ..... 347/102
See application file for complete search history.

(56) References Cited

U.S. PATENT DOCUMENTS

| | | | | |
|---|---|---|---|---|
| 2002/0019458 | A1* | 2/2002 | Hirasa et al. | 523/160 |
| 2005/0151815 | A1* | 7/2005 | Kanai et al. | 347/102 |
| 2008/0282932 | A1* | 11/2008 | Kiyomoto et al. | 106/31.65 |
| 2011/0234727 | A1* | 9/2011 | Aoki et al. | 347/102 |
| 2014/0192112 | A1 | 7/2014 | Nagashima et al. | |
| 2014/0267520 | A1 | 9/2014 | Toda et al. | |

FOREIGN PATENT DOCUMENTS

| | | |
|---|---|---|
| JP | 2005-220352 | 8/2005 |
| JP | 2011-094082 | 5/2011 |

OTHER PUBLICATIONS

U.S. Appl. No. 14/297,868, filed Jun. 6, 2014.
U.S. Appl. No. 14/320,859, filed Jul. 1, 2014.

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

An inkjet recording method includes recording an image on a heated nonpermeable substrate with an aqueous ink by an inkjet method; and drying the aqueous ink, wherein the method satisfies the following requirements (1) to (3):

(1) the aqueous ink comprises water, a hydrosoluble organic solvent, a pigment and a particulate resin, wherein the hydrosoluble organic solvent comprises a solvent having a boiling point not higher than 200° C. in an amount not less than 50% by weight;

(2) the hydrosoluble organic solvent having a boiling point not higher than 200° C. comprises 3-methoxy-3-methyl-1-butanol; and (3) a difference of heating temperatures between the recording and the drying is from 25 to 80° C.

14 Claims, 2 Drawing Sheets

INKJET RECORDING METHOD AND INKJET RECORDER

CROSS-REFERENCE TO RELATED APPLICATIONS

This patent application is based on and claims priority pursuant to 35 U.S.C. §119 to Japanese Patent Application No. 2013-260197, filed on Dec. 17, 2013, in the Japan Patent Office, the entire disclosure of which is hereby incorporated by reference herein.

BACKGROUND

1. Technical Field

The present invention relates to an aqueous inkjet recording method and an inkjet recorder ideal for recording on a nonpermeable substrate.

2. Description of the Related Art

Inkjet printers have been widely used as digital signal output equipment in general homes because of having advantages such as low noise, low running cost, and easiness of color printing.

In recent years, inkjet techniques have been increasingly utilized not only in such homes but also for industrial applications such as a display, a poster, and a bulletin board. Since porous substrates used in the industrial applications have problems of durability such as light resistance, water resistance and abrasion resistance, nonpermeable substrates such as plastic films are used and inks therefor are developed.

As such inks, for example, solvent-based inkjet inks using an organic solvent as a vehicle, and ultraviolet curable inkjet inks including a polymerizable monomer as a main component have been ever used widely. However, the solvent-based inkjet inks are not preferable in terms of environmental load because the solvent is evaporated in the atmosphere, and the ultraviolet curable inkjet inks have limited application fields because they may have skin sensitizing properties depending on the monomer to be used and an expensive ultraviolet irradiation apparatus is required to be incorporated to the main body of a printer.

In view of such background, there have been recently developed inkjet inks capable of being directly recordable (printable) on the nonpermeable substrates, which are aqueous inks for inkjet recording which give less environmental load and which have been widely used as inkjet inks for household use. Examples of such known arts are disclosed in Japanese published unexamined applications Nos. JP-2005-220352-A and JP-2001-094082-A.

However, such aqueous inks generally have several drawbacks pointed out in terms of image quality, as compared with the solvent-based inkjet inks.

First, since the ink does not permeate the nonpermeable substrates basically, the ink thereon needs quickly drying, but is difficult to dry due to water as a main solvent of the aqueous ink and a hydrosoluble organic solvent as an additive. Therefore, it is easily conceivable blocking occurs, i.e., the ink transfers to the back of prints when overlapped or rolled.

Many of the nonpermeable substrates have gloss, and an ink capable of giving high gloss is required not to impair uniformity of recorded and unrecorded parts. Different from a solvent ink a resin is dissolved in, the aqueous ink forms a coat film with fusion-bonded particles, and the coat film is likely to have rough surface and less gloss.

SUMMARY

Accordingly, one object of the present invention is to provide an inkjet recording method capable of forming a uniform image without forming a gap on a nonpermeable substrate by spreading an ink droplet thereon, having high smoothness, image density and glossiness, and toughness such as abrasion resistance and ethanol resistance.

Another object of the present invention is to provide an inkjet recorder using the inkjet recording method.

These objects and other objects of the present invention, either individually or collectively, have been satisfied by the discovery of an inkjet recording method, including recording an image on a heated nonpermeable substrate with an aqueous ink by an inkjet method; and drying the aqueous ink, wherein the method satisfies the following requirements (1) to (3): (1) the aqueous ink comprises water, a hydrosoluble organic solvent, a pigment and a particulate resin, wherein the hydrosoluble organic solvent comprises a solvent having a boiling point not higher than 200° C. in an amount not less than 50% by weight; (2) the hydrosoluble organic solvent having a boiling point not higher than 200° C. comprises 3-methoxy-3-methyl-1-butanol; and (3) a difference of heating temperature between the recording and the drying is from 25 to 80° C.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
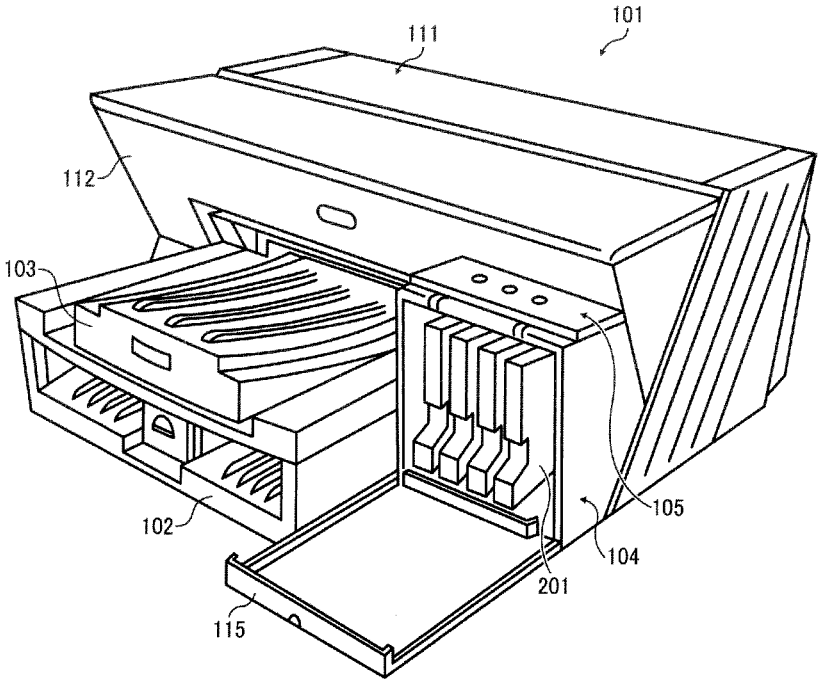
FIG. 1 is a schematic view illustrating an embodiment of the serial-type inkjet recorder of the present invention.

The present invention provides an inkjet recording method capable of forming a uniform image without forming a gap on a nonpermeable substrate by spreading an ink droplet thereon, having high smoothness, image density and glossiness, and toughness such as abrasion resistance and ethanol resistance.

The ink for use in the present invention includes at least water, a hydrosoluble organic solvent, a pigment and a particulate resin.

Hereinafter, these are explained in order.

<Hydrosoluble Organic Solvent>

In the present invention, the hydrosoluble organic solvent needs to include a solvent having a boiling point not higher than 200° C. in an amount not less than 50% by weight. When less than 50% by weight, the resultant ink deteriorates in dryability and is not capable of forming a sufficient coat film, resulting in blocking.

Besides 3-methoxy-3-methyl-1-butanol (bp: 174° C.), specific examples of the hydrosoluble organic solvent having a boiling point of lower than 200° C. include, but are not limited to ethylene glycol (bp: 196° C.), propylene glycol (bp: 188° C.), 1,2-butanediol (bp: 194° C.), 2,3-butanediol (bp: 183° C.), 2-methyl-2,4-pentanediol (bp: 198° C.), dipropylene glycol monomethyl ether (bp: 190° C.), propylene glycol n-butyl ether (bp: 171° C.), propylene glycol t-butyl ether (bp: 153°

C.), diethylene glycol methyl ether (bp: 194° C.), ethylene glycol n-propyl ether (bp: 150° C.), and ethylene glycol n-butyl ether (bp: 171° C.).

These may be used alone or in combination.

Furthermore, the solvent preferably contains propylene glycol and 2,3-butanediol because the solvent is compatible with the polycarbonate-based urethane resin to provide an ink better in film formation properties such as glossiness.

Specific examples of other hydrosoluble organic solvents used when necessary for the purpose of controlling ink properties, preventing the ink from drying and improving solution stability, include polyols such as diethylene glycol, triethylene glycol, dipropylene glycol, 1,3-propanediol, 1,3-butanediol, 1,4-butanediol, 2,2-dimethyl-1,3-propanediol, 2-methyl-1,3-propanediol, 1,2-pentanediol, 2,4-pentanediol, 1,5-pentanediol, 1,6-hexanediol, 2-ethyl-1,3-hexanediol, 1,2-hexanediol and 2,5-hexanediol, polyhydric alcohol alkyl ethers such as dipropylene glycol n-propyl ether, tripropylene glycol methyl ether, tripropylene glycol n-propyl ether, propylene glycol phenyl ether, triethylene glycol methyl ether, triethylene glycol methyl ether, triethylene glycol ethyl ether, diethylene glycol n-hexyl ether and ethylene glycol phenyl ether, and nitrogen-containing heterocyclic compounds such as 2-pyrrolidone and N-methylpyrrolidinone.

However, in order to further enhance drying properties, the organic solvent preferably contains no solvent having a boiling point higher than 250° C.

The ink preferably includes the hydrosoluble organic solvent in an amount of from 20 to 70% by weight. When is less than 20% by weight, moisture-retaining properties as the ink cannot be sufficiently ensured to cause the deterioration in discharge stability. When greater than 70% by weight, the ink not only has too high a viscosity but also is inferior in drying properties on a nonpermeable substrate, and thus printing quality can be low.

<Pigment>

As the pigment, any of an inorganic pigment and an organic pigment can be used.

As the inorganic pigment, for example, in addition to titanium oxide, iron oxide, calcium carbonate, barium sulfate, aluminum hydroxide, Barium Yellow, Cadmium Red, and Chrome Yellow, carbon black produced by a known method such as a contact method, a furnace method, and a thermal method can be used.

Examples of the organic pigment include azo pigments (including am lakes, insoluble azo pigments, condensed azo pigments, and chelate azo pigments), polycyclic pigments (for example, phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (for example, basic dye-type chelates and acidic dye-type chelates), nitro pigments, nitroso pigments, and aniline black.

The pigment preferably has affinity with a solvent.

Specific examples of the pigment for black ink include carbon black (C.I. Pigment Black 7) such as furnace black, lamp black, acetylene black, and channel black; metals such as copper, iron (C.I. Pigment Black 11); metal oxides such as titanium oxide; and organic pigments such as aniline black (C.I. Pigment Black 1).

Specific examples of the pigment for color ink include C.I. Pigment Yellow 1, 3, 12, 13, 14, 17, 24, 34, 35, 37, 42 (Yellow Iron Oxide), 53, 55, 74, 81, 83, 95, 97, 98, 100, 101, 104, 108, 109, 110, 117, 120, 128, 139, 150, 151, 155, 153, 180, 183, 185 and 213, C.I. Pigment Orange 5, 13, 16, 17, 36, 43 and 51, C.I. Pigment Red 1, 2, 3, 5, 17, 22, 23, 31, 38, 48:2, 48:2 (Permanent Red 2B (Ca)), 48:3, 48:4, 49:1, 52:2, 53:1, 57:1 (Brilliant Carmine 6B), 60:1, 63:1, 63:2, 64:1, 81, 83, 88, 101 (Rouge), 104, 105, 106, 108 (Cadmium Red), 112, 114, 122 (Quinacridone Magenta), 123, 146, 149, 166, 168, 170, 172, 177, 178, 179, 185, 190, 193, 209 and 219, C.I. Pigment Violet 1 (Rhodamine Lake), 3, 5:1, 16, 19, 23 and 38, C.I. Pigment Blue 1, 2, 15 (Phthalocyanine Blue), 15:1, 15:2, 15:3 (Phthalocyanine Blue), 16, 17:1, 56, 60 and 63; and C.I. Pigment Green 1, 4, 7, 8, 10, 17, 18 and 36.

Besides, a self-dispersible pigment formed of a pigment such as carbon blacks, on the surface of which functional groups such as sulfonic group and carboxyl groups are added, which is dispersible in water can be used. The pigment may be included in a microcapsule, which is dispersible in water. This is a particulate resin including a pigment in other words. In this case, not all the pigments included in the ink need not be included in or adsorbed to the particulate resin. The pigment may be dispersed in the ink unless the effect of the present invention is impaired.

The particle diameter of the pigment is not particularly limited, but preferably has a maximum frequency of the maximum number conversion of from 20 to 150 nm. When greater than 150 nm, the resultant ink deteriorates in not only pigment dispersion and stability and discharge stability, but also in image quality such as image density. When less than 20 nm, the ink has storage and discharge stability, but is difficult to economically produce due to complicated dispersion and classification processes. When a pigment is dispersed with a dispersant, known dispersants such as polymeric dispersants and hydrosoluble surfactants can be used.

<Particulate Resin>

The particulate resin is added to the ink to obtain a printed article that is quickly recorded and fixed on a nonpermeable substrate, that exhibits sufficient adhesiveness and durability, and that is for use in such severe environments as outdoor applications.

As the particulate resin, in addition to urea-based, melamine-based and phenol-based ones conventionally known, acrylic or PVAc-based (including PVA) emulsion-type ones or the like that can be expected to have hot-melt properties and thus are currently used heavily in the adhesive field or ones made of a modified resin (copolymer) obtained by further introducing a curing reactive group to the emulsion-type ones, or ones made of a urethane-based emulsion are preferably used. The particulate resin may be any fine particles made of a resin material, having a high aggregating force to thereby be excellent in water resistance, heat resistance, wear resistance and weather resistance.

Particularly, a particulate resin capable of forming a film excellent in affinity with 3-methoxy-3-methyl-1-butanol and excellent in hardness and toughness after drying is preferably used.

The particulate resin may be any fine particles made of a resin material, having a high aggregating force to thereby be excellent in water resistance, heat resistance, wear resistance and weather resistance. Typically, for example, polycarbonate-based particulate urethane resin is suitable for printed articles for use in such severe environments as outdoor applications because of being excellent in water resistance, heat resistance, wear resistance and weather resistance due to the high aggregating force of a carbonate group.

The polycarbonate-based urethane resin in the present invention refers to one obtained by reacting a polycarbonate polyol and a polyisocyanate.

As the polycarbonate polyol, for example, one obtained by subjecting a carbonate ester and a polyol to a trans-esterification reaction in the presence of a catalyst, and one obtained by reacting phosgene and bisphenol A can be used.

As the carbonate ester, for example, methyl carbonate, dimethyl carbonate, ethyl carbonate, diethyl carbonate, cyclocarbonate, and diphenyl carbonate can be used. As the polyol to be reacted with the carbonate ester, for example, low molecular weight diol compounds such as ethylene glycol, diethylene glycol, 1,2-propylene glycol, dipropylene glycol, 1,4-butanediol, 1,5-pentanediol, 3-methyl-1,5-pentanediol neopentyl glycol and 1,4-cyclohexanediol, polyethylene glycol, and polypropylene glycol can be used.

The polyisocyanate that can be used in the present invention is not particularly limited, and examples thereof include aromatic polyisocyanate compounds such as 1,3-phenylene diisocyanate, 1,4-phenylene diisocyanate, 2,4-tolylene diisocyanate (TDI), 2,6-tolylene diisocyanate, 4,4'-diphenylenemethane diisocyanate (MDI), 2,4-diphenylmethane diisocyanate, 4,4'-diisocyanatobiphenyl, 3,3'-dimethyl-4,4'-diisocyanatobiphenyl, 3,3'-dimethyl-4,4'-diisocyanatodiphenylmethane, 1,5-naphthylene diisocyanate, m-isocyanatophenylsulfonyl isocyanate and p-isocyanatophenylsulfonyl isocyanate; aliphatic polyisocyanate compounds such as ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate and 2-isocyanatoethyl-2,6-diisocyanatohexanoate; and alicyclic polycyanate compounds such as isophorone diisocyanate (IPDI), 4,4'-dicyclohexylmethane diisocyanate (hydrogenated MDI), cyclohexylene diisocyanate, methylcyclohexylene diisocyanate (hydrogenated TDI), bis(2-isocyanatoethylohycloexene-1,2-dicarboxylate, 2,5-norbornane diisocyanate and 2,6-norbornane diisocyanate.

These can be used alone or in combination.

Since the ink of the present invention is supposed to be used in outdoor applications such as a poster and an advertising display, a coating film having a very high long-term weather resistance is needed, and from this viewpoint an aliphatic or alicyclic diisocyanate is preferably used.

Furthermore, at least one alicyclic diisocyanate is preferably contained in the ink of the present invention. It is effective that the polycarbonate-based particulate urethane resin has a structure derived from at least one alicyclic diisocyanate because scratch resistance and ethanol resistance are enhanced. In particular, isophorone diisocyanate and dicyclohexylmethane diisocyanate can be suitably used.

The proportion of the alicyclic diisocyanate is preferably 60% or more by weight in the entire isocyanate compound.

In the present invention, the polycarbonate-based urethane fine particles can be added in the form of resin emulsion in which the particles are dispersed in an aqueous medium. The resin solid content in the resin emulsion is preferably 20% by weight or more, and if the content is less than 20% by weight, it is difficult to design the formulation during formation of the ink, and such content is not preferable. The particulate urethane resin here preferably has an average particle size in the range of 10 to 350 nm in terms of liquid storage stability and discharge stability during formation of the ink.

In addition, when the urethane fine particles are dispersed in an aqueous medium, a forced emulsified type emulsion in which a dispersant is utilized can be used, but the dispersant may remain in the coating film to result in the reduction in strength, and thus a so-called self-emulsification type emulsion in which a molecular structure has anionicity can be suitably used. In such a case, an anionic group is preferably contained so that the acid value is 20 to 100 mgKOH/g, from the viewpoint of imparting excellent scratch resistance and chemical resistance. As the anionic group, for example, a carboxyl group, a carboxylate group, a sulfonic acid group, and a sulfonate group can be used, and among them, a carboxylate group and a sulfonate group partially or entirely neutralized by a basic compound are preferably used from the viewpoint of maintaining a good water dispersing stability.

Examples of the basic compound usable for neutralizing the anionic group include ammonia, organic amines such as triethylamine, pyridine and morpholine, alkanol amines such as monoethanolamine, and metal base compounds including Na, K, Li, Ca, and the like.

When a forced emulsification method is used, any of a non-ionic surfactant and an anionic surfactant can be used, but a non-ionic surfactant is more preferable because of making water resistance better.

Examples of the non-ionic surfactant include polyoxyethylene alkyl ether, polyoxyethylene alkylene alkyl ether, polyoxyethylene derivatives, polyoxyethylene fatty acid ester, polyoxyethylene polyhydric alcohol fatty acid ester, polyoxyethylene propylene polyol, sorbitan fatty acid ester, polyoxyethylene hydrogenated castor oil, polyoxyalkylene polycyclic phenyl ether, polyoxyethylene alkylamine, alkyl alkanol amide, and polyalkylene glycol(meth)acrylate. Preferable examples thereof include polyoxyethylenealkyl ether, polyoxyethylene fatty acid ester, polyoxyethylene sorbitan fatty acid ester, and polyoxyethylene alkylamine.

Examples of the anionic surfactant include an alkyl sulfate salt, polyoxyethylene alkyl ether sulfate, alkylbenzene sulfonate, α-olefin sulfonate, a methyl taurate salt, sulfosuccinate, ether sulfonate, ether carboxylate, a fatty acid salt, a naphthalene sulfonic acid formaldehyde condensate, an alkylamine salt, a quaternary ammonium salt, alkyl betaine, and alkylamine oxide, and preferable examples thereof include polyoxyethylene alkyl ether sulfate and sulfosuccinate.

The amount of the surfactant added is preferably 0.1 to 30% by weight and more preferably 5 to 20% by weight relative to that of the urethane resin. If the amount exceeds 30% by weight, an excess amount of an emulsifier above the amount required for forming a urethane resin emulsion causes adhering properties and water resistance to be remarkably deteriorated, and when the emulsion is formed into a dry film, a plasticization effect and a bleeding phenomenon are caused and blocking is easily caused, and thus such an amount is not preferable.

In addition, the methane resin emulsion in the present invention can be blended with a hydrosoluble organic solvent, a preservative agent, a leveling agent, an antioxidant, a light stabilizer, an ultraviolet absorbing agent, and the like, if necessary.

Any method conventionally commonly used can be used for producing the polycarbonate-based particulate urethane resin, and examples thereof are as follows.

First, the polycarbonate polyol and the polyisocyanate are reacted without a solvent or in the presence of an organic solvent in such an equivalent ratio that an isocyanate group is excessive, to produce an isocyanate-terminal urethane prepolymer. Then, the anionic group in the isocyanate-terminal urethane prepolymer is if necessary neutralized by the neutralizing agent and then reacted with a chain extender, and the organic solvent in the system is finally removed, if necessary, to provide the polycarbonate-based particulate urethane resin. Examples of the organic solvent usable here include ketones such as acetone and methyl ethyl ketone, ethers such as tetrahydrofuran and dioxane, acetates such as ethyl acetate and butyl acetate, nitriles such as acetonitrile, and amides such as dimethylformamide, N-methyl pyrrolidone and N-ethyl pyrrolidone. These may be used alone or in combination.

As the chain extender, polyamine or other active hydrogen atom-containing compound can be used, and as the polyamine, for example, diamines such as ethylenediamine, 1,2-propanediamine, 1,6-hexamethylenediamine, piperazine, 2,5-dimethylpiperazine, isophoronediamine, 4,4'-dicyclohexylmethane diamine and 1,4-cyclohexane diamine, polyamines such as diethylenetriamine, dipropylenetriamine and triethylenetetramine, hydrazines such as hydrazine, N,N'-dimethylhydrazine and 1,6-hexamethylenebishydrazine, and dihydrazides such as succinic acid dihydrazide, adipic acid dihydrazide, glutaric acid dihydrazide, sebacic acid dihydrazide and isophthalic acid dihydrazide can be used.

As the other active hydrogen-containing compound, for example, glycols such as ethylene glycol, diethylene glycol, triethylene glycol, propylene glycol, 1,3-propanediol, 1,3-butanediol, 1,4-butanediol, hexamethylene glycol, saccharose, methylene glycol, glycerin and sorbitol, phenols such as bisphenol A, 4,4'-dihydroxydiphenyl, 4,4'-dihydroxydiphenyl ether, 4,4'-dihydroxydiphenyl sulfone, hydrogenated bisphenol A and hydroquinone, and water can be used.

Since the ink of the present invention is supposed to be used for printing on the non-porous substrate heated, the minimum film formation temperature may not be necessarily equal to or lower than room temperature in order to form a film from the polycarbonate-based particulate urethane resin for use in the present invention, but the temperature is required to be at least equal to or lower than a temperature at which heating is performed during printing. The minimum film formation temperature of the urethane resin emulsion is preferably 0° C. or higher and lower than the heating temperature by 5° C. or higher, and further preferably 25° C. or higher and lower than the heating temperature by 10° C. or higher.

In general, while a lower minimum film formation temperature is better in terms of film formation properties, too low a minimum film formation temperature causes a resin to have a low glass transition point, not providing a sufficient coating film strength.

Herein, the minimum film formation temperature refers to the lowest temperature at which a transparent continuous film is formed when the emulsion is thinly cast on a metal plate made of aluminum or the like and heated, and the emulsion is in the form of white powder in a temperature region less than the minimum film formation temperature.

The surface hardness of the polycarbonate-based urethane resin for use in the present invention is preferably 100 N/mm$^2$ or more, and when such a condition is satisfied, the ink of the present invention can form a tough coating film to achieve a stronger scratch resistance.

The surface hardness in the present invention can be measured by, for example, the following method.

The polycarbonate-based urethane resin emulsion is applied on a glass slide so that the film thickness is 10 μm, and then the resultant is dried at 100° C. for 30 minutes to form a resin film. The resin film can be used to determine the surface hardness as a Martens hardness when the resin film is pressed by a Vickers indenter under a load of 9.8 mN using a surface microhardness tester (FISCHERSCOPE HM2000 manufactured by Fischer Instruments K. K.).

In the ink of the present invention, the polycarbonate-based particulate urethane resin is preferably added in an amount of 0.5% by weight or more and 10% by weight or less, more preferably 1% by weight or more and 8% by weight or less, further preferably 3% by weight or more and 8% by weight or less, in terms of solid content. If the amount added is less than 0.5% by weight, the coat film is not sufficiently formed on a pigment to result in poor image fastness, and if the amount added exceeds 10% by weight, the ink has too high a viscosity and is not easily discharged.

The ink of the present invention may contain a resin other than the polycarbonate-based particulate urethane resin, but 50%, by weight or more of the resin added to the ink is preferably constituted by the polycarbonate-based urethane resin, and 70% by weight or more thereof is more preferably constituted by the polycarbonate-based urethane resin, in order that the effect of the invention is sufficiently satisfied.

Examples of the particulate resin that can be contained, other than the polycarbonate-based particulate urethane resin, include acrylic particulate resin, polyolefin particulate resin, vinyl acetate particulate resin, vinyl chloride particulate resin, fluoro particulate resin, polyether-based particulate resin, and polyester-based particulate resin.

Specific examples of the other various additives added when necessary include a surfactant, an antiseptic/antifungal agent, an anticorrosive agent, and a pH adjuster.

The surfactant is added in order to ensure wettability to a medium. The ink preferably includes of the surfactant in an amount of from 0.1 to 5% by weight. When below 0.1% by weight, wettability on the non-porous substrate is not sufficient to cause the degradation in image quality, and when greater than 5% by weight, the ink easily foams to cause non-discharge.

While any of an amphoteric surfactant, a non-ionic surfactant, and an anionic surfactant can be used, non-ionic surfactants such as polyoxyethylene alkyl phenyl ether, polyoxyethylene alkyl ester, polyoxyethylene alkylamine, polyoxyethylene alkylamide, a polyoxyethylene propylene block polymer, sorbitan fatty acid ester, polyoxyethylene sorbitan fatty acid ester and an ethylene oxide adduct of acetylene alcohol are preferably used in terms of a relationship between dispersing stability of the color material and image quality.

In addition, a fluorine-based surfactant and a silicone-based surfactant can be used in combination (or alone) depending on formulation.

Specific examples of the antiseptic/antifungal agent include, but are not limited to, 1,2-benzisothiazolin-3-one, sodium benzoate, sodium dehydroacetate, sodium sorbate, sodium pentachlorophenol, and sodium 2-pyridinethiol-1-oxide.

Specific examples of the anticorrosive agent include acidic sulfite, sodium thiosulfate, ammonium thiodiglycolate, diisopropylammonium nitrite, pentaerythritol tetranitrate, and dicyclohexylammonium nitrite.

As the pH adjuster, any substance can be used as long as it can adjust the pH to the desired value without having any adverse effect on the ink formulated. Examples thereof include hydroxides of alkali metal elements, such as lithium hydroxide, sodium hydroxide and potassium hydroxide, carbonates of alkali metals, such as lithium carbonate, sodium carbonate and potassium carbonate, quaternary ammonium hydroxide, amines such as diethanolamine and triethanolamine, ammonium hydroxide, and quaternary phosphonium hydroxide.

The ink of the present invention is produced by dispersing or dissolving the components in an aqueous medium, and further stirring and mixing the resultant, if necessary. The stirring and mixing can be performed by a stirrer using a usual stirring blade, a magnetic stirrer, a high-speed disperser, or the like, but the present invention does not depend on the production method.

The ink of the present invention applied to a nonpermeable substrate forms an image having particularly good glossiness and toughness. The nonpermeable substrate is formed of plastic materials such as transparent or colored polyvinylchloride (PVC) films, polyethyleneterephthalate (PET) films and polycarbonate films.

(Inkjet Recorder)

The inkjet recorder of the present invention includes at least an ink flyer applying an energy to an ink to fly to record an image, a conveyor conveying a substrate and a heater heating the (nonpermeable) substrate to fix the ink thereon.

The ink flyer is a unit for applying a stimulus to the ink constituting the present invention to thereby allow the ink to be ejected, forming an image.

The ink flyer is not particularly limited, and can be appropriately selected depending on the object Examples thereof include various recording heads (ink discharge heads), and in particular, one having a head having a plurality of nozzle rows and a sub-tank for accommodating a liquid supplied from a tank for liquid storage to supply the liquid to the head is preferable. The sub-tank preferably includes a negative pressure generator generating a negative pressure therein, an atmosphere releaser releasing an atmosphere therein and a detector detecting presence of the ink with a difference of electrical resistance.

The stimulus can be generated by a stimulus-generator, the stimulus is not particularly limited and can be appropriately selected depending on the object, and examples thereof include heat (temperature), pressure, vibration, and, light. These may be used alone or in combination. Among them, heat and pressure are suitable.

Herein, examples of the stimulus-generator include a heating apparatus, a pressurizing apparatus, a piezoelectric element, a vibration-generating apparatus, an ultrasonic wave oscillator, and a light. Specific examples thereof include piezoelectric actuators such as a piezoelectric element, a thermal actuator utilizing a phase transition of liquid due to film boiling using an electrothermal conversion element such as a heat resistor, a shape memory alloy actuator using a metal phase transition due to change in temperature, and a static actuator using an electrostatic force.

The mode of flying the ink is not particularly limited and is different depending on the type of the stimulus, and when the stimulus is "heat", examples of the mode include a method in which heat energy corresponding to a recording signal is applied to the ink in a recording head using a thermal head or the like to thereby allow the ink to generate air bubbles, and the pressure of the air bubbles allows the ink to be discharged and jetted as droplets from a nozzle hole of the recording head.

In addition, when the stimulus is "pressure", examples of the mode include a method in which a voltage is applied to a piezoelectric element bonded to a position called pressure chamber located in an ink passage in a recording head, to deflect the piezoelectric element and to decrease the volume of the pressure chamber, discharging and jetting the ink as droplets from a nozzle hole of the recording head.

The method of applying a voltage to a piezo element is effectively used to fly an ink including a resin because of generating no heat Particularly, the method effectively prevents an ink including a wetter less from clogging a nozzle.

Further, it is preferable to apply a voltage to the piezo element so as not to discharge an ink and perform blank scan in order to prevent nozzle from falling out.

Further, it is preferable to discharge an ink in an ink reservoir before the blank scan reaches one page printing.

A scraper scraping an ink anchored on a black discharge receiver is preferably included. The scraper is preferably a wiper or a cutter.

Known conveyors such as a transfer roller or a transfer belt can be used as the conveyors conveying a substrate. The conveying process is performed by the conveyor conveying the substrate.

The ink of the present invention is capable of recording high-quality images on a nonpermeable substrate. The substrate needs heating to form images having higher quality, abrasion resistance and adhesiveness at high speed when recorded, and further needs heating and drying after recorded.

One or plural known heaters can be used as the heater heating the (nonpermeable) substrate to fix the ink thereon. Specific examples of the heaters include forced-air heaters, radiation heaters, conduction heaters and microwave driers. These can be used alone or in combination.

The heater may be installed in the inkjet printers or attached thereto.

The beating temperature can be changed according to the hydrosoluble organic solvent and its quantity, and the minimum film-forming temperature of the polycarbonate-based urethane resin emulsion included in the ink. Further, the temperature can be changed according to the substrate. The heating temperature is preferably high in terms of dryability and film-forming temperature. However, when too high, the substrate may be damaged and even the ink head may be heated, resulting in possible non-discharge. Typically, the substrate is preferably heated at from 30 to 60° C., and ore preferably from 30 to 45° C. when recorded. Preferably not higher than 110° C. after recorded.

Figure 2:
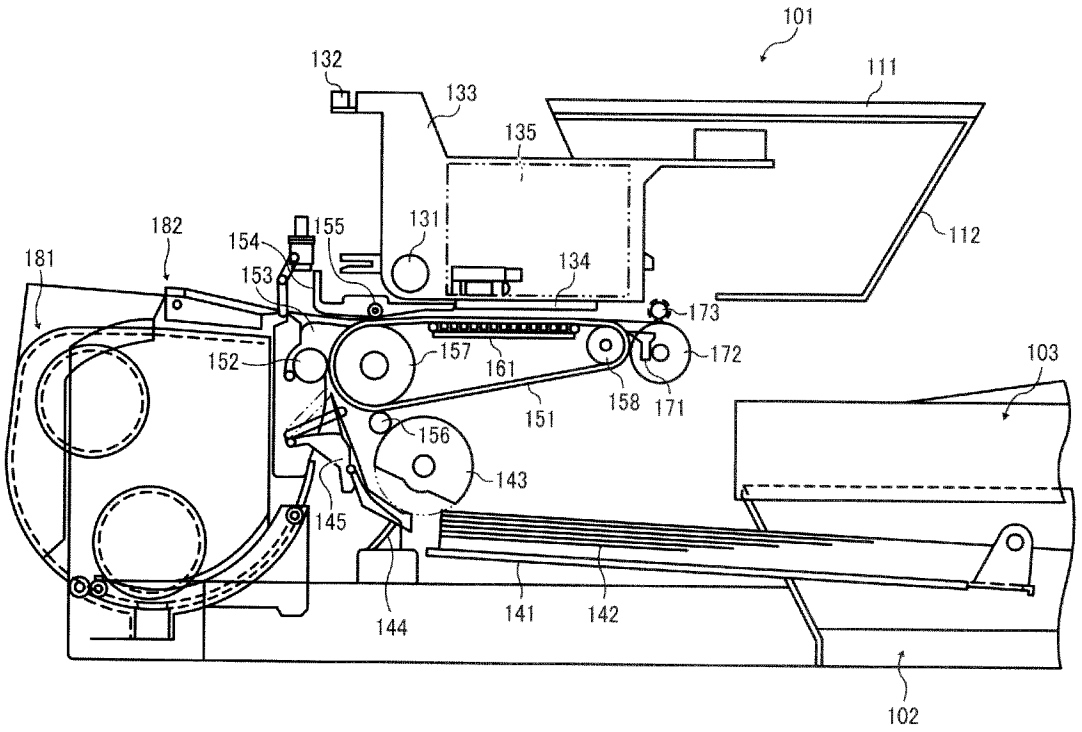
FIG. 2 is a schematic view illustrating the internal configuration of the inkjet recorder in FIG. 1.

The inkjet recorder of the present invention is explained, referring to FIGS. 1 and 2. FIG. 1 is a schematic view illustrating an embodiment of the inkjet recorder of the present invention, and FIG. 2 is a schematic view illustrating the internal configuration of the inkjet recorder in FIG. 1.

The inkjet recorder illustrated in FIG. 1 includes a main body 101 thereof, a recording sheet feed tray 102, which is attached to the main body 101 and on which a stack of nonpermeable substrates is set, a copy tray 103, which is attached to the main body 101 and on which the substrates bearing ink images thereon are stacked, and an ink cartridge setting portion 104 to which ink cartridges 200 are detachably attached. On the upper surface of the ink cartridge setting portion 104, an operating portion 105 including operation keys, a display, etc. is arranged. The ink cartridge setting portion 104 has a front cover 115 which is openable and closable so that the ink cartridges 200 can be attached to the ink cartridge setting portion 104 or detached therefrom. Numerals 111 and 112 respectively denote an upper cover of the inkjet recorder, and a front cover of the apparatus.

As illustrated in FIG. 2, a carriage 133 is slidably supported by a guide rod 131 and a stay 132, which are supported by both side plates (not shown) of the main body 101, so that the carriage 133 is moved in a main scanning direction by a main scanning motor (not shown) to perform a scanning operation (i.e., an image forming operation).

An inkjet recording head 134 including four inkjet recording heads, each of which has multiple nozzles arranged in a direction perpendicular to the main scanning direction (A) to eject droplets of yellow (Y), magenta (M), cyan (C) or black (K) inkjet ink downward, is provided on the carriage 133.

Each of the four inkjet recording heads 134 includes an energy generator to eject ink droplets. Specific examples of the energy generator include, but are not limited thereto, piezoelectric actuators (e.g., piezoelectric devices), thermal actuators to eject ink droplets utilizing phase change of ink by boiling a liquid film using an electrothermal device such as a resistor, shape memory alloy actuators utilizing phase change of metal caused by temperature change, and electrostatic actuators utilizing electrostatic force.

In addition, sub-tanks 135 containing the color inkjet inks to supply the color inkjet inks to the respective recording heads 134 are provided on the carriage 133. The color inkjet inks in the ink cartridges 200 set to the ink cartridge setting portion 104 are supplied to the respective sub-tanks 135 via respective ink supplying tubes (not shown).

The inkjet recorder includes a recording sheet supplier to feed substrates 142 set on a sheet loading portion (pressing plate) 141. The recording sheet supplier includes a sheet feeding roller 143 to feed the substrates 142, and a separation pad 144, which faces the sheet feeding roller 143 while being biased toward the sheet feeding roller 143 and which is made of a material having a high friction coefficient, to feed the substrates 142 one by one from the sheet loading portion 141.

The inkjet recorder further includes a feeder to feed the substrate 142, which is fed from the recording sheet supplier, toward the image recording area located below the inkjet recording head 134. The feeder includes a feeding belt 151 to feed the substrate 142 while electrostatically attracting the recording sheet, a counter roller 152 to feed the substrate 142, which is fed from the recording sheet supplier along a guide 145, while sandwiching the substrate 142 with the feeding belt 151, a direction changing guide 153 to change the direction of the substrate 142, which is fed substantially vertically, at an angle of about 90° so that the substrate 142 is contacted with the feeding belt 151 so as to be fed thereby, a pressing roller 155 which is biased toward the feeding belt 151 by a pressing member 154, and a charging roller 156 to charge the surface of the feeding belt 151.

The feeding belt 151 is an endless belt, which is tightly stretched by a feeding roller 157 and a tension roller 158 so as to be rotated in a recording sheet feeding direction (i.e., a sub-scanning direction (B)) perpendicular to the main scanning direction (A). For example, the feeding belt 151 includes a first layer (i.e., an uppermost layer), which electrostatically attracts the substrate 142 and which is made of a resin layer (such as a tetrafluoroethylene-ethylene copolymer (ETFE) whose electric resistance is not controlled) with a thickness of about 40 μm, and a second layer (i.e., a medium resistance layer or a grounding layer), which is made of almost the same material as that of the first layer except that carbon black is included therein so that the second layer has a medium electric resistance. In addition, a guide member 161 is arranged below the feeding belt 151 so as to face the image recording area in which an image is recorded on the substrate 142 by the inkjet recording head 134. The inkjet recorder further includes a sheet discharger to discharge the substrate 142, which bears an image recorded by the inkjet recording head 134, from the main body 101. The sheet discharger includes a separation pick 171 to separate the substrate 142 from the feeding belt 151, and discharging rollers 172 and 173 to discharge the substrate 142 toward the copy tray 103 located below the discharging roller 172.

A duplex copy unit 181 is detachably attached to the backside of the main body 101 of the inkjet recorder. The duplex copy unit 181 receives the substrate 142, which is fed to the duplex copy unit 181 by reversely rotating the feeding belt 151, and feeds again the substrate 142 to the nip between the counter roller 152 and the feeding belt 151 so that another image is formed on the backside of the substrate 142 by the inkjet recording heads 134 in the image recording area. A manual sheet feeder 182, by which a recording sheet can be manually fed to the inkjet recorder, is provided above the duplex copy unit 181.

The substrate 142 is supplied one by one by the recording material supplier. The substrate 142 thus fed in substantially the vertical direction is guided by the guide 145 to the nip between the feeding belt 151 and the counter roller 152 so as to be fed by the feeding belt 151 and the counter roller 152. Further, the substrate 142 is guided by the direction changing guide 153 so that the direction of the sheet is changed at an angle of about 90°. The substrate 142 is then fed by the feeding belt 151 while pressed toward the feeding belt 151 by the pressing roller 155.

In this regard, since the feeding belt 151 is charged by the charging roller 156, the substrate 142 is fed by the feeding belt 151 while electrostatically adhered thereto.

Next, the carriage 133 is moved in the main scanning direction while the inkjet recording head 134 is driven according to image signals so as to eject droplets of the color inkjet inks to form one line image on the surface of the substrate 142, which is stopped in the image forming operation. After recording one line image, the substrate 142 is fed in a predetermined length in the sub-scanning direction, and the next image forming operation is performed to form another one line image on the surface of the recording material sheet 142. By repeating the image forming operation, an image is formed on the surface of the recording material sheet 142. When the inkjet recorder receives a signal such that the image recording operation is completed or the rear edge of the substrate 142 reaches the image recording area, the inkjet recorder stops the image forming operation, and the sheet discharger discharges the substrate 142 bearing the image thereon to the copy tray 103.

A serial type (shuttle type) in which the carriage scans is used in this description but this description is true in a line-type inkjet recorder having a line type head.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

<Preparation of Polycarbonate-Based Urethane Resin Emulsion A>

To a reaction container into which a stirrer, a reflux condenser and a thermometer were inserted were charged 1,500 g of polycarbonate diol (reaction product of 1,6-hexanediol and dimethyl carbonate), 220 g of 2,2-dimethylol propionic acid (DMPA) and 1347 g of N-methylpyrrolidone (NMP) under a nitrogen stream, and heated to 60° C. to dissolve DMPA.

Thereto were added 1,445 g of 4,4'-dicyclohexylmethane diisocyanate and 2.6 g of dibutyl tin dilaurate (catalyst), and heated to 90° C. to perform a urethanization reaction over 5 hours, providing a isocyanate-terminal urethane prepolymer.

The reaction mixture was cooled to 80° C., 149 g of triethylamine was added thereto and mixed, and 4,340 g of the resultant was taken out and added to a mixed solution of 5,400 g of water and 15 g of triethylamine under strong stirring.

Then, 1,500 g of ice was charged thereto, 626 g of an aqueous 35% 2-methyl-1,5-pentanediamine solution was added thereto to perform a chain-extending reaction, and the solvent was distilled off so that the solid content concentration was 30%, providing polycarbonate-based urethane resin emulsion A.

Polycarbonate-based urethane resin emulsion A obtained was applied on a glass slide so that the film thickness was 10 μm, the resultant was dried at 100° C. for 30 minutes to form a resin film, and a Vickers indenter was pressed on the resin film using a microhardness tester (FISCHERSCOPE HM2000, manufactured by Fischer Instruments K. K.) under a load of 9.8 mN and the Martens hardness was here 120 $N/mm^2$.

<Preparation of Polycarbonate-Based Urethane Resin Emulsion B>

Polycarbonate-based urethane resin emulsion B having a solid content concentration of 30% by mass was obtained in the same manner except that hexamethylene diisocyanate was used instead of 4,4'-dicyclohexylmethane diisocyanate in the production of polycarbonate-based urethane resin emulsion A.

The coating film strength of polycarbonate-based urethane resin emulsion B obtained was measured in the same manner, and the Martens hardness was 88 $N/mm^2$.

<Preparation of Black Pigment Dispersion>

The following formulation mixture was pre-mixed, and then circulated and dispersed by a disc-type bead mill (Shinmaru Enterprises Corporation, KDL-type, medium: zirconia ball having a diameter of 0.3 mm was used) for 7 hours to prepare a black pigment dispersion.

| | |
|---|---|
| Carbon black pigment | 15 |
| Anionic surfactant (Pionin A-51-B produced by Takemoto Oil & Fat Co., Ltd.) | 2 |
| Ion-exchanged water | 83 |

<Preparation of Cyan Pigment Dispersion>

The procedure for preparation of the black pigment dispersion was repeated except for replacing the carbon black pigment with C.I. Pigment Blue 15:3 to prepare a cyan pigment dispersion.

<Preparation of Magenta Pigment Dispersion>

The procedure for preparation of the black pigment dispersion was repeated except for replacing the carbon black pigment with C.I. Pigment Red 122 to prepare a magenta pigment dispersion.

<Preparation of Yellow Pigment Dispersion>

The procedure for preparation of the black pigment dispersion was repeated except for replacing the carbon black pigment with C.I. Pigment Yellow 74 to prepare a yellow pigment dispersion.

Example 1

The black pigment dispersion was used, and mixed and stirred in the following formulation, and thereafter the resultant was subjected to filtration by a 0.2 μm polypropylene filter to prepare an ink.

| | |
|---|---|
| Black pigment dispersion | 20 |
| Polycarbonate-based urethane resin emulsion A | 15 |
| Surfactant $CH_3(CH_2)_{12}O(CH_2CH_2O)_3CH_2COOH$ | 2 |
| Propylene glycol (bp 188° C.) | 20 |
| 3-methoxy-3-methyl-1-butanol (bp 174° C.) | 5 |
| Diethyleneglycol-n-butyl ether (bp 230° C.) | 10 |
| Antiseptic/Antifungal Agent (Proxel LV produced by Avecia Inc.) | 0.1 |
| Ion-exchanged water | 27.9 |

The ink produced as described above was evaluated by the following method. The results are shown in Table 2.

<Evaluation of Dryability>

Each of the inks produced was loaded to an inkjet printer (IPSiO, GXe5500 manufactured Ricoh Company Ltd.) to print a solid image on a gloss coat paper (OK Top Coat+from Oji Paper Co., Ltd.) heated to 25° C. and thereafter further dried at 25° C. for a predetermined time.

Filter paper was pressed on the solid portion after drying, and the degree of the ink transferred to the filter paper was observed to determine the drying properties according to the following criteria.

A: Transfer to filter paper is not observed under drying conditions of 60° C. and less than 15 minutes.

B: Transfer to filter paper is not observed under drying conditions of 60° C. and less than 30 minutes.

C: Transfer to filter paper is not observed under drying conditions of 60° C. and less than 60 minutes.

D: Transfer to filter paper is observed even under drying conditions of 60° C. and 60 minutes.

<Evaluation of Solid Image Areal Ratio>

Each of the inks produced was loaded to an inkjet printer (IPSiO, GXe5500 manufactured Ricoh Company Ltd.) to print a solid image on a PVC film (IJ5331 from Sumitomo 3M Limited), and thereafter further dried for 1 hour. The heating temperatures when recording and drying are shown in Table 1.

The dried solid image was observed with a microscope VHX-200 from Keyence Corp. at 20 times to evaluate the ink adherence area.

A: 97% or more

B: 95% or more and less than 97%

C: 92% or more and less than 95%

D: Less than 92%

<Evaluation of Glossiness>

Each of the inks produced was loaded to an inkjet printer (IPSiO, GXe5500 manufactured Ricoh Company Ltd.) to print a solid image on a PVC film (IJ5331 from Sumitomo 3M Limited), and thereafter further dried for 1 hour. The heating temperatures when recording and drying are shown in Table 1.

Then, the glossiness at 60° of the solid image was measured by a gloss meter (4501 manufactured by BYK Gardener), and evaluated according to the following criteria.

A: Glossiness at 60° is not less than 100%.

B: Glossiness at 60° is not less than 81% and less than 100%.

C: Glossiness at 60° is not less than and less than 80%.

D: Glossiness at 60° is less than 60%.

<Evaluation of Scratch Resistance>

Each of the inks produced was loaded to an inkjet printer (IPSiO, GXe5500 manufactured Ricoh Company Ltd.) to print a solid image on a PVC film (IJ5331 from Sumitomo 3M Limited), and thereafter further dried for 1 hour. The heating temperatures when recording and drying are shown in Table 1.

The solid portion was scratched by dry cotton (Kanakin #3) under a load of 400 g, and the scratch resistance was determined according to the following criteria.

A: Image is not changed even after being scratched 50 times or more.

B: Some scratch remains at the stage of scratching for 50 times, but has no effect on image density and is not problematic for practical use.

C: Image density is reduced during scratching for 21 to 50 times.

D: Image density is reduced during scratching for 20 times or less.

<Evaluation of Ethanol Resistance>

Each of the inks produced was loaded to an inkjet printer (IPSiO, GXe5500 manufactured Ricoh Company Ltd.) to print a solid image on a PVC film (IJ5331 from Sumitomo 3M Limited), and thereafter further dried for 1 hour. The heating temperatures when recording and drying are shown in Table 1.

A cotton applicator was impregnated with an aqueous 50% ethanol solution to scratch the solid portion of an image 20 times, and the degree of scratching of a coating film on the solid portion was observed, and determined according to the following criteria.

A: No scratching is observed on solid portion at all, and also no contamination is observed on cotton applicator.

B: No scratching is observed on solid portion, but slight contamination is adhered on cotton applicator.

C: Melting out of ink is observed on solid portion.

D: Ink on solid portion is scratched and background is partially or more than partially exposed.

Examples 2 to 13

The procedure for preparation and evaluation of the ink in Example 1 were repeated except for changing the formulation as shown in Table 1 to prepare and evaluate inks of Examples 2 to 13.

Examples 14

The procedure for preparation and evaluation of the ink in Example 1 were repeated except for changing the heating temperature when recording to 30° C. and that when drying to 110° C.

Examples 15

The procedure for preparation and evaluation of the ink in Example 1 were repeated except for changing the heating temperature when recording to 45° C. and that when drying to 70° C.

Examples 16

The procedure for preparation and evaluation of the ink in Example 1 were repeated except for changing the heating temperature when recording to 25° C. and that when drying to 70° C.

Examples 17

The procedure for preparation and evaluation of the ink in Example 1 were repeated except for changing the heating temperature when recording to 50° C. and that when drying to 90° C.

Comparative Example 1

The procedure for preparation and evaluation of the ink in Example 1 were repeated except for changing a ratio of the hydrosoluble organic solvent having a boiling point not higher than 200° C. to total of the hydrosoluble organic solvent into 33.3%.

Comparative Example 2

The procedure for preparation and evaluation of the ink in Example 2 were repeated except for not adding the particulate resin.

Comparative Example 3

The procedure for preparation and evaluation of the ink in Example 3 were repeated except for not adding 3-methoxy-3-methyl-1-butanol.

Comparative Example 4

The procedure for preparation and evaluation of the ink in Example 1 were repeated except for changing the heating temperature when recording to 30° C. and that when drying to 50° C.

Comparative Example 5

The procedure for preparation and evaluation of the ink in Example 1 were repeated except for changing the heating temperature when recording to 60° C. and that when drying to 80° C.

TABLE 1

| | | Ex. | | | | |
|---|---|---|---|---|---|---|
| | Ink Component | 1 | 2 | 3 | 4 | 5 |
| Pigment Dispersion | Black Pigment Dispersion | 20 | — | — | — | 20 |
| | Magenta Pigment Dispersion | — | 20 | — | — | — |
| | Cyan Pigment Dispersion | — | — | 15 | — | — |
| | Yellow Pigment Dispersion | — | — | — | 15 | — |
| Hydrosoluble Organic Solvent | 3-Methoxy-3-methyl-1-butanol (bp 174° C.) | 5 | 5 | 5 | 10 | 5 |
| | Propylene glycol (bp 188° C.) | 20 | — | 15 | — | 20 |
| | 2,3-Butanediol (bp 183° C.) | — | 20 | — | 20 | — |
| | 1,2-Butanediol (bp 194° C.) | — | — | — | — | — |
| | 2-Methyl-2,4-pentanediol (bp 198° C.) | — | — | — | — | — |
| | Diethylene glycol n-butyl ether (bp 230° C.) | 10 | — | 10 | 10 | 10 |
| | Ethylene glycol n-hexyl ether (bp 208° C.) | — | 10 | 10 | — | — |
| | Tripropylene glycol n-propyl ether (bp 261° C.) | — | 20 | — | — | — |
| | Triethylene glycol (bp 287° C.) | — | — | — | — | — |

TABLE 1-continued

| | | | | | | |
|---|---|---|---|---|---|---|
| Particulate Resin | Polycarbonate-based urethane resin emulsion A | 15 | 15 | 10 | 10 | — |
| | Polycarbonate-based urethane resin emulsion B | — | — | — | — | 15 |
| | Polyether-based urethane resin emulsion (Acrit WBR-016U produced by Taisei Fine Chemical Co., Ltd.) | — | — | — | — | — |
| | Polyester-based urethane resin emulsion (UCOAT UWS-148 produced by Sanyo Chemical Industries, Ltd.) | — | — | — | — | — |
| | Acrylic resin emulsion (Voncoat R-3380-E produced by DIC Corporation) | — | — | — | 5 | — |
| Surfactant | $CH_3(CH_2)_{12}O(CH_2CH_2O)_3CH_2COOH$) | 2 | 2 | 2 | 2 | 2 |
| Antifungal Agent | Proxel LV | 0.1 | 0.1 | 0.1 | 0.1 | 0.1 |
| Ion-Exchanged Water | | 27.9 | 27.9 | 32.9 | 27.9 | 27.9 |
| | Total | 100 | 100 | 100 | 100 | 100 |
| Ratio of Solvent having a bp less than 200° C. | | 0.71 | 0.71 | 0.50 | 0.75 | 0.71 |
| Recording & Drying Condition | Heating temperature when recording | 40° C. | 40° C. | 40° C. | 40° C. | 40° C. |
| | Heating temperature when drying | 90° C. | 90° C. | 90° C. | 90° C. | 90° C. |
| | Difference between the above | 50° C. | 50° C. | 50° C. | 50° C. | 50° C. |

| | | Ex. | | | | |
|---|---|---|---|---|---|---|
| | Ink Component | 6 | 7 | 8 | 9 | 10 |
| Pigment Dispersion | Black Pigment Dispersion | — | — | — | — | — |
| | Magenta Pigment Dispersion | 20 | — | — | — | — |
| | Cyan Pigment Dispersion | — | 15 | — | 20 | — |
| | Yellow Pigment Dispersion | — | — | 15 | — | 20 |
| Hydrosoluble Organic Solvent | 3-Methoxy-3-methyl-1-butanol (bp 174° C.) | 5 | 5 | 5 | 5 | 5 |
| | Propylene glycol (bp 188° C.) | — | — | — | 20 | — |
| | 2,3-Butanediol (bp 183° C.) | 20 | — | — | — | 20 |
| | 1,2-Butanediol (bp 194° C.) | — | 25 | — | — | — |
| | 2-Methyl-2,4-pentanediol (bp 198° C.) | — | — | 25 | — | — |
| | Diethylene glycol n-butyl ether (bp 230° C.) | — | 10 | 10 | — | — |
| | Ethylene glycol n-hexyl ether (bp 208° C.) | 10 | — | — | — | — |
| | Tripropylene glycol n-propyl ether (bp 261° C.) | — | — | — | 10 | — |
| | Triethylene glycol (bp 287° C.) | — | — | — | — | 10 |
| Particulate Resin | Polycarbonate-based urethane resin emulsion A | — | 10 | 15 | 15 | 15 |
| | Polycarbonate-based urethane resin emulsion B | 15 | — | — | — | — |
| | Polyether-based urethane resin emulsion (Acrit WBR-016U produced by Taisei Fine Chemical Co., Ltd.) | — | — | — | — | — |
| | Polyester-based urethane resin emulsion (UCOAT UWS-148 produced by Sanyo Chemical Industries, Ltd.) | — | — | — | — | — |
| | Acrylic resin emulsion (Voncoat R-3380-E produced by DIC Corporation) | — | — | — | — | — |
| Surfactant | $CH_3(CH_2)_{12}O(CH_2CH_2O)_3CH_2COOH$) | 2 | 2 | 2 | 2 | 2 |
| Antifungal Agent | Proxel LV | 0.1 | 0.1 | 0.1 | 0.1 | 0.1 |
| Ion-Exchanged Water | | 27.9 | 32.9 | 27.9 | 27.9 | 27.9 |
| | Total | 100 | 100 | 100 | 100 | 100 |
| Ratio of Solvent having a bp less than 200° C. | | 0.71 | 0.75 | 0.75 | 0.71 | 0.71 |
| Recording & Drying Condition | Heating temperature when recording | 40° C. | 40° C. | 40° C. | 40° C. | 40° C. |
| | Heating temperature when drying | 90° C. | 90° C. | 90° C. | 90° C. | 90° C. |
| | Difference between the above | 50° C. | 50° C. | 50° C. | 50° C. | 50° C. |

TABLE 1-continued

| | Ink Component | Ex. 11 | Ex. 12 | Ex. 13 | Ex. 14 | Ex. 15 |
|---|---|---|---|---|---|---|
| Pigment Dispersion | Black Pigment Dispersion | 20 | — | — | 20 | 20 |
| | Magenta Pigment Dispersion | — | 20 | — | — | — |
| | Cyan Pigment Dispersion | — | — | — | — | — |
| | Yellow Pigment Dispersion | — | — | 15 | — | — |
| Hydrosoluble Organic Solvent | 3-Methoxy-3-methyl-1-butanol (bp 174° C.) | 5 | 5 | 5 | 5 | 5 |
| | Propylene glycol (bp 188° C.) | 20 | — | — | 20 | 20 |
| | 2,3-Butanediol (bp 183° C.) | — | 20 | 25 | — | — |
| | 1,2-Butanediol (bp 194° C.) | — | — | — | — | — |
| | 2-Methyl-1-2,4-pentanediol (bp 198° C.) | — | — | — | — | — |
| | Diethylene glycol n-butyl ether (bp 230° C.) | 10 | — | — | 10 | 10 |
| | Ethylene glycol n-hexyl ether (bp 208° C.) | — | 10 | 10 | — | — |
| | Tripropylene glycol n-propyl ether (bp 261° C.) | — | — | — | — | — |
| | Triethylene glycol (bp 287° C.) | — | — | — | — | — |
| Particulate Resin | Polycarbonate-based urethane resin emulsion A | — | — | — | 15 | 15 |
| | Polycarbonate-based urethane resin emulsion B | — | — | — | — | — |
| | Polyether-based urethane resin emulsion (Acrit WBR-016U produced by Taisei Fine Chemical Co. Ltd.) | 15 | — | — | — | — |
| | Polyester-based urethane resin emulsion (UCOAT UWS-148 produced by Sanyo Chemical Industries, Ltd.) | — | 15 | — | — | — |
| | Acrylic resin emulsion (Voncoat R-3380-E produced by DIC Corporation) | — | — | 15 | — | — |
| Surfactant | $CH_3(CH_2)_{12}O(CH_2CH_2O)_3CH_2COOH$) | 2 | 2 | 2 | 2 | 2 |
| Antifungal Agent | Proxel LV | 0.1 | 0.1 | 0.1 | 0.1 | 0.1 |
| Ion-Exchanged Water | | 27.9 | 32.9 | 27.9 | 27.9 | 27.9 |
| | Total | 100 | 100 | 100 | 100 | 100 |
| Ratio of Solvent having a bp less than 200° C. | | 0.71 | 0.71 | 0.75 | 0.71 | 0.71 |
| Recording & Drying Condition | Heating temperature when recording | 40° C. | 40° C. | 40° C. | 30° C. | 45° C. |
| | Heating temperature when drying | 90° C. | 90° C. | 90° C. | 110° C. | 70° C. |
| | Difference between the above | 50° C. | 50° C. | 50° C. | 80° C. | 25° C. |

| | Ink Component | Ex. 16 | Ex. 17 |
|---|---|---|---|
| Pigment Dispersion | Black Pigment Dispersion | 20 | 20 |
| | Magenta Pigment Dispersion | — | — |
| | Cyan Pigment Dispersion | — | — |
| | Yellow Pigment Dispersion | — | — |
| Hydrosoluble Organic Solvent | 3-Methoxy-3-methyl-1-butanol (bp 174° C.) | 5 | 5 |
| | Propylene glycol (bp 188° C.) | 20 | 20 |
| | 2,3-Butanediol (bp 183° C.) | — | — |
| | 1,2-Butanediol (bp 194° C.) | — | — |
| | 2-Methyl-2,4-pentanediol (bp 198° C.) | — | — |
| | Diethylene glycol n-butyl ether (bp 230° C.) | 10 | 10 |
| | Ethylene glycol n-hexyl ether (bp 208° C.) | — | — |
| | Tripropylene glycol n-propyl ether (bp 261° C.) | — | — |
| | Triethylene glycol (bp 287° C.) | — | — |
| Particulate Resin | Polycarbonate-based urethane resin emulsion A | 15 | 15 |
| | Polycarbonate-based urethane resin emulsion B | — | — |
| | Polyether-based urethane resin emulsion (Acrit WBR-016U produced by Taisei Fine Chemical Co., Ltd.) | — | — |

TABLE 1-continued

| | | | |
|---|---|---|---|
| | Polyester-based urethane resin emulsion (UCOAT UWS-148 produced by Sanyo Chemical Industries, Ltd.) | — | — |
| | Acrylic resin emulsion (Voncoat R-3380-E produced by DIC Corporation) | — | — |
| Surfactant | $CH_3(CH_2)_{12}O(CH_2CH_2O)_3CH_2COOH$) | 2 | 2 |
| Antifungal Agent | Proxel LV | 0.1 | 0.1 |
| Ion-Exchanged Water | | 27.9 | 27.9 |
| | Total | 100 | 100 |
| Ratio of Solvent having a bp less than 200° C. | | 0.71 | 0.71 |
| Recording & Drying Condition | Heating temperature when recording | 25° C. | 50° C. |
| | Heating temperature when drying | 70° C. | 90° C. |
| | Difference between the above | 45° C. | 40° C. |

| | | Com. Ex. | | | | |
|---|---|---|---|---|---|---|
| | Ink Component | 1 | 2 | 3 | 4 | 5 |
| Pigment Dispersion | Black Pigment Dispersion | 20 | — | — | 20 | 20 |
| | Magenta Pigment Dispersion | — | 20 | — | — | — |
| | Cyan Pigment Dispersion | — | — | 15 | — | — |
| | Yellow Pigment Dispersion | — | — | — | — | — |
| Hydrosoluble Organic Solvent | 3-Methoxy-3-methyl-1-butanol (bp 174° C.) | 5 | 5 | — | 5 | 5 |
| | Propylene glycol (bp 188° C.) | 10 | — | 20 | 20 | 20 |
| | 2,3-Butanediol (bp 183° C.) | — | 20 | — | — | — |
| | 1,2-Butanediol (bp 194° C.) | — | — | 10 | — | — |
| | 2-Methyl-2,4-pentanediol (bp 198° C.) | — | — | — | — | — |
| | Diethylene glycol n-butyl ether (bp 230° C.) | 20 | — | 10 | 10 | 10 |
| | Ethylene glycol n-hexyl ether (bp 208° C.) | — | 10 | — | — | — |
| | Tripropylene glycol n-propyl ether (bp 261° C.) | — | — | — | — | — |
| | Triethylene glycol (bp 287° C.) | — | — | — | — | — |
| Particulate Resin | Polycarbonate-based urethane resin emulsion A | 15 | — | 10 | 15 | 15 |
| | Polycarbonate-based urethane resin emulsion B | — | — | — | — | — |
| | Polyehter-based urethane resin emulsion (Acrit WBR-016U produced by Taisei Fine Chemical Co., Ltd.) | — | — | — | — | — |
| | Polyester-based urethane resin emulsion (UCOAT UWS-148 produced by Sanyo Chemical Industries, Ltd.) | — | — | — | — | — |
| | Acrylic resin emulsion (Voncoat R-3380-E produced by DIC Corporation) | — | — | — | 5 | — |
| Surfactant | $CH_3(CH_2)_{12}O(CH_2CH_2O)_3CH_2COOH$) | 2 | 2 | 2 | 2 | 2 |
| Antifungal Agent | Proxel LV | 0.1 | 0.1 | 0.1 | 0.1 | 0.1 |
| Ion-Exchanged Water | | 27.9 | 42.9 | 32.9 | 27.9 | 27.9 |
| | Total | 100 | 100 | 100 | 100 | 100 |
| Ratio of Solvent having a bp less than 200° C. | | 0.43 | 0.71 | 0.75 | 0.75 | 0.71 |
| Recording & Drying Condition | Heating temperature when recording | 40° C. | 40° C. | 40° C. | 30° C. | 60° C. |
| | Heating temperature when drying | 90° C. | 90° C. | 90° C. | 50° C. | 80° C. |
| | Difference between the above | 50° C. | 50° C. | 50° C. | 20° C. | 20° C. |

TABLE 2

| | Evaluation Result | | | | |
|---|---|---|---|---|---|
| | Dryability | Image Areal Ratio | Glossiness | Scratch Resistance | Ethanol Resistance |
| Ex. 1 | A | A | A | A | A |
| Ex. 2 | A | A | A | A | A |
| Ex. 3 | A | A | A | A | A |
| Ex. 4 | A | A | A | A | A |
| Ex. 5 | A | A | A | A | B |
| Ex. 6 | A | A | A | B | A |
| Ex. 7 | A | A | B | A | A |
| Ex. 8 | B | A | B | A | A |
| Ex. 9 | B | B | B | A | A |
| Ex. 10 | B | A | B | B | A |
| Ex. 11 | A | B | B | B | B |
| Ex. 12 | A | A | B | B | B |
| Ex. 13 | A | A | B | B | B |
| Ex. 14 | A | A | A | A | A |
| Ex. 15 | A | A | A | A | A |
| Ex. 16 | A | A | B | A | B |
| Ex. 17 | A | B | B | A | A |
| Com. Ex. 1 | D | C | C | C | B |
| Com. Ex. 2 | A | B | D | D | D |
| Com. Ex. 3 | B | C | C | B | B |
| Com. Ex. 4 | A | B | C | C | D |
| Com. Ex. 5 | A | C | C | B | B |

Table 2 proves Examples 1 to 4, 14 and 15 have good dryability, image density, glossiness and image toughness, regardless of differences of colors and solvents. These have the best effects in all Examples.

Namely, satisfying the particulate resin is a polycarbonate-based particulate urethane resin having a structure originating from aliphatic diisocyanate, Examples 1 and 2 are superior in scratch resistance and ethanol resistance to Examples 5 and 6. In addition, satisfying the hydrosoluble organic solvent does not include a solvent having high boiling point higher than 250° C., Examples 1 and 2 are superior in dryability and glossiness to Examples 9 and 10. Further, using the polycarbonate-based particulate urethane resin, Examples 1 and 2 are superior in glossiness and image toughness to Examples 1 to 13.

Satisfying the heating temperature when recording is from 30 to 45° C., Example 1 is superior in image density, glossiness and ethanol resistance to Examples 15 and 16.

Examples 3 and 4 are slightly superior in dryability and glossiness to Examples 7 and 8 which do not include propylene glycol and/or 2,3-butanediol as a hydrosoluble organic solvent having a boiling point not higher than 200° C.

Comparative Example 1 does not satisfy specifications of the hydrosoluble organic solvent in Claim 1, and has unusable dryability.

Comparative Example 2 does not include a particulate resin, though dryable, has almost no glossiness and image toughness because a pigment is just placed on a substrate.

Comparative Example 3 does not include 3-methoxy-3-methyl-1-butanol, and has no smoothness, and poor image density and glossiness because ink droplet does not fully expand.

Comparative Examples 4 and 5 have a small difference between heating temperatures when recording and drying, and do not sufficiently form a film, resulting in no glossiness and image toughness.

Having now fully described the invention, it will be apparent to one of ordinary skill in the art that many changes and modifications can be made thereto without departing from the spirit and scope of the invention as set forth therein.

What is claimed is:

1. An inkjet recording method, comprising:

recording an image on a heated nonpermeable substrate with an aqueous ink by an inkjet method; and drying the aqueous ink, wherein the method satisfies the following requirements (1) to (3):

(1) the aqueous ink comprises water, a hydrosoluble organic solvent, a pigment and a particulate resin, wherein the hydrosoluble organic solvent comprises a solvent having a boiling point not higher than 200° C. in an amount not less than 50% by weight;

(2) the hydrosoluble organic solvent having a boiling point not higher than 200° C. comprises 3-methoxy-3-methyl-1-butanol; and (3) a difference of heating temperatures between the recording and the drying is from 25 to 80° C., wherein the particulate resin is a polycarbonate-based particulate urethane resin, and wherein content of the polycarbonate-based particulate urethane resin in the aqueous ink is 0.5% by weight or more and 10% by weight or less.

2. The inkjet recording method of claim 1, wherein the heating temperature when recording is from 30 to 45° C.

3. The inkjet recording method of claim 1, wherein the hydrosoluble organic solvent having a boiling point not higher than 200° C. comprises at least one of propylene glycol and 2,3-butanediol.

4. The inkjet recording method of claim 1, wherein the hydrosoluble organic solvent does not comprises a solvent having a boiling point higher than 250° C.

5. The inkjet recording method of claim 1, wherein the polycarbonate-based particulate urethane resin comprises a structure originating from at least one aliphatic diisocyanate.

6. The inkjet recording method of claim 1, wherein the polycarbonate-based particulate urethane resin is included as a resin emulsion in which particles of the polycarbonate-based particulate urethane resin are dispersed in an aqueous medium.

7. The inkjet recording method of claim 6, wherein resin solid content in the resin emulsion is 20% by weight or more.

8. The inkjet recording method of claim 1, wherein surface hardness of the polycarbonate-based urethane resin is 100 $N/mm^2$ or more.

9. An inkjet recorder, comprising:

an ink flyer configured to apply an energy to an aqueous ink for inkjet to fly and form an image;

a heater configured to heat a nonpermeable substrate when recording;

a transferer configured to transfer the substrate; and a heater and dryer configured to heat the substrate to fix an ink droplet thereon, wherein the recorder satisfies the following requirements (1) to (3):

(1) the aqueous ink comprises water, a hydrosoluble organic solvent, a pigment and a particulate resin, wherein the hydrosoluble organic solvent comprises a solvent having a boiling point not higher than 200° C. in an amount not less than 50% by weight;

(2) the hydrosoluble organic solvent having a boiling point not higher than 200° C. comprises 3-methoxy-3-methyl-1-butanol; and (3) a difference of heating temperatures between the recording and the drying is from 25 to 80° C., wherein the particulate resin is a polycarbonate-based particulate urethane resin, and wherein content of the polycarbonate-based particulate urethane resin in the aqueous ink is 0.5% by weight or more and 10% by weight or less.

10. A recording method, comprising:

recording an image on a heated nonpermeable substrate with an aqueous ink; and drying the aqueous ink, wherein the method satisfies the following requirements (1) to (3):

(1) the aqueous ink comprises water, a hydrosoluble organic solvent, a pigment and a particulate resin, wherein the hydrosoluble organic solvent comprises a solvent having a boiling point not higher than 200° C. in an amount not less than 50% by weight;

(2) the hydrosoluble organic solvent having a boiling point not higher than 200° C. comprises 3methoxy-3-methyl-1-butanol; and (3) a difference of heating temperatures between the recording and the drying is from 25 to 80° C., wherein the particulate resin is a polycarbonate-based particulate urethane resin, and wherein content of the polycarbonate-based particulate urethane resin in the aqueous ink is 0.5% by weight or more and 10% by weight or less.

11. The recording method of claim 10, wherein the heating temperature when recording is from 30 to 45° C.

12. The recording method of claim 10, wherein the hydrosoluble organic solvent having a boiling point not higher than 200° C. comprises at least one of propylene glycol and 2,3-butanediol.

13. The recording method of claim 10, wherein the hydrosoluble organic solvent does not comprises a solvent having a boiling point higher than 250° C.

14. The recording method of claim 10, wherein the polycarbonate-based particulate urethane resin comprises a structure originating from at least one aliphatic diisocyanate.

* * * * *